US009010666B2

(12) United States Patent
Nied et al.

(10) Patent No.: US 9,010,666 B2
(45) Date of Patent: Apr. 21, 2015

(54) JET MILL AND METHOD FOR OPERATION OF A JET MILL

(75) Inventors: Roland Nied, Bonstetten (DE); Hermann Sickel, Gambach/Muenzenberg (DE); Dimitrios Makrakis, Hof (DE)

(73) Assignees: NETZSCH Trockenmahltechnik GmbH (DE); Roland Nied (DE)

( * ) Notice: Subject to any disclaimer, the term of this patent is extended or adjusted under 35 U.S.C. 154(b) by 335 days.

(21) Appl. No.: 13/481,138

(22) Filed: May 25, 2012

(65) Prior Publication Data

US 2012/0298782 A1 Nov. 29, 2012

(30) Foreign Application Priority Data

May 27, 2011 (DE) ..... 10 2011 102 614

(51) Int. Cl.
*B02C 19/06* (2006.01)

(52) U.S. Cl.
CPC ..... *B02C 19/068* (2013.01)

(58) Field of Classification Search
USPC ..... 241/5, 39, 18, 23
See application file for complete search history.

(56) References Cited

U.S. PATENT DOCUMENTS

| | | | | |
|---|---|---|---|---|
| 2006/0257491 | A1* | 11/2006 | Morton et al. | 424/489 |
| 2007/0202053 | A1* | 8/2007 | Bilzi et al. | 424/46 |
| 2009/0136672 | A1* | 5/2009 | Panz et al. | 427/397.7 |
| 2009/0269412 | A1* | 10/2009 | Staniforth et al. | 424/490 |
| 2011/0262543 | A1* | 10/2011 | Cocconi et al. | 424/489 |

FOREIGN PATENT DOCUMENTS

| | | | |
|---|---|---|---|
| DE | 4431534 | A1 | 8/1995 |
| DE | 69906147 | T2 | 12/2003 |
| DE | 69908650 | T2 | 5/2004 |
| DE | 102006048850 | A1 | 4/2008 |

* cited by examiner

*Primary Examiner* — Mark Rosenbaum
(74) *Attorney, Agent, or Firm* — St. Onge Steward Johnston & Reens LLC

(57) ABSTRACT

A method for the operation of a jet mill with an integrated dynamic air classifier, wherein particles are fed as grinding stock into a grinding chamber of the jet mill and are ground there into ultra-fine particles by grinding, in that superheated steam or technical gases is/are used as working stock, wherein at least one surface-active additive is fed to the grinding stock for stabilization of the generated ultra-fine particles. A jet mill for performing this method, having an integrated dynamic air classifier, and a grinding chamber into which superheated steam or technical gases are provided as working stock via working stock feed devices as grinding stock and in which the grinding stock is ground into ultra-fine particles by grinding, and wherein feeding devices for at least one surface-active additive for stabilization of the generated ultra-fine particles are provided.

10 Claims, 3 Drawing Sheets

JET MILL AND METHOD FOR OPERATION OF A JET MILL

CROSS-REFERENCE TO RELATED APPLICATIONS

The present application claims priority of German patent application No. 10 2011 102 614.6 filed on May 27, 2011, the content of which is incorporated herein by reference.

FIELD OF THE INVENTION

The present invention relates to a method for operating a jet mill and a jet mill for performing a method of feeding and grinding particles as grinding stock into a grinding chamber of a jet mill.

BACKGROUND OF THE INVENTION

During the production of ultra-fine particles by milling, the surface of the milled solid increases approximately reciprocally to the square of the particle size. At the same time, the particle mass decreases by the power of three of the particle size. Because of these physical factors, surface-active forces such as the van der Waal force or electrostatic forces gain a disproportionate effect with decreasing particles size.

This can especially be observed in the range of $d_{50}<2$ μm, with a heavily increasing tendency when the particles are even smaller. As a consequence, the generated ultra-fine particles will re-agglomerate. The air classifier integrated into the fluidized bed as well as in the high-density bed jet mills to limit the upper particle size prevents the discharge of these agglomerates consisting of the finest particles (which it "detects" as coarse particles) from the mill, so that these are supplied for reprocessing. Milling energy is therefore used again to deagglomerate the already fine particles again, which immediately form new agglomerates again. This results in a large increase in the energy requirement of the milling.

SUMMARY OF THE INVENTION

The present invention has the objective which it accomplishes to design the operation of jet mills more efficiently.

This objective is accomplished with a method for the operation of a jet mill and a jet mill.

The invention accordingly creates a method for the operation of a jet mill with an integrated dynamic air classifier, wherein particles are being supplied as grinding stock into a grinding chamber of the jet mill, where they are ground by milling into ultra-fine particles, in that superheated steam, which can also be described as process or milling steam, or also technical gases (He, $H_2$) which can also be described as process or milling gases, is/are used. For this purpose, at least one surface-active additive is fed into the grinding stock for stabilization of the generated ultra-fine particles.

Such additives for stabilization of the generated ultra-fine particles can be supplied within the scope of preferred embodiments

- be mixed with the grinding stock prior to grinding,
- be introduced directly into the grinding chamber, and/or
- be supplied to the jet mill together with the working stock.

It is further preferred if the working stock contains technical gases (He, $H_2$) and has an inlet temperature of at least 50° C.

Alternatively it can preferably be provided that the working stock is superheated steam, which has at least such inlet temperature that it is dry downstream of the jet mill.

A further preferred embodiment consists in that at least one surface-active additive for stabilization of the generated ultra-fine particles contains:

- stearic acid for hydrophobic stabilization, or
- diols, polyalcohols or other long-chain alcohols for hydrophilic stabilization.

Moreover, it can preferably be provided that at least one surface-active additive for stabilization of the generated ultra-fine particles contains:

- silanes, and/or
- condensates of naphthalene sulfonic acid or of phenol sulfonic acid.

It is furthermore preferred that the additive addition is approximately 0.1% to approximately 4% of the mass flow rate of the jet mill.

The invention furthermore creates a jet mill for performing the method, with an integrated dynamic air classifier, wherein a grinding chamber is provided, into which particles are supplied as grinding stock via grinding stock feed devices as well as superheated steam or technical gases (He, $H_2$) are fed as working stock via working stock feed devices and in which the grinding stock is ground into ultra-fine particles by grinding, and wherein feed devices for at least one surface-active additive for stabilization of the created ultra-fine particles are provided.

The feed devices for the at least one surface-active additive preferably discharge into the grinding stock feed devices, into the grinding chamber and/or into the working stock feed devices.

It is further preferred if the jet mill is a fluidized bed jet mill or a high-density bed jet mill.

A further preferred embodiment consists in that the working stock feed devices contain at least one working stock jet, which surrounds a central inlet port for the at least one additive in the form of a ring. This can preferably furthermore be developed such that the at least one working stock jet is an I-jet.

Further preferred and/or advantageous embodiments of the invention and their individual aspects result from the combination of the dependent claims as well as from the entire present application documents.

BRIEF DESCRIPTION OF THE DRAWINGS

In the following, the invention is explained in greater detail merely by means of exemplary embodiments with reference to the drawing, in which.

DETAILED DESCRIPTION OF THE INVENTION

Figure 1:
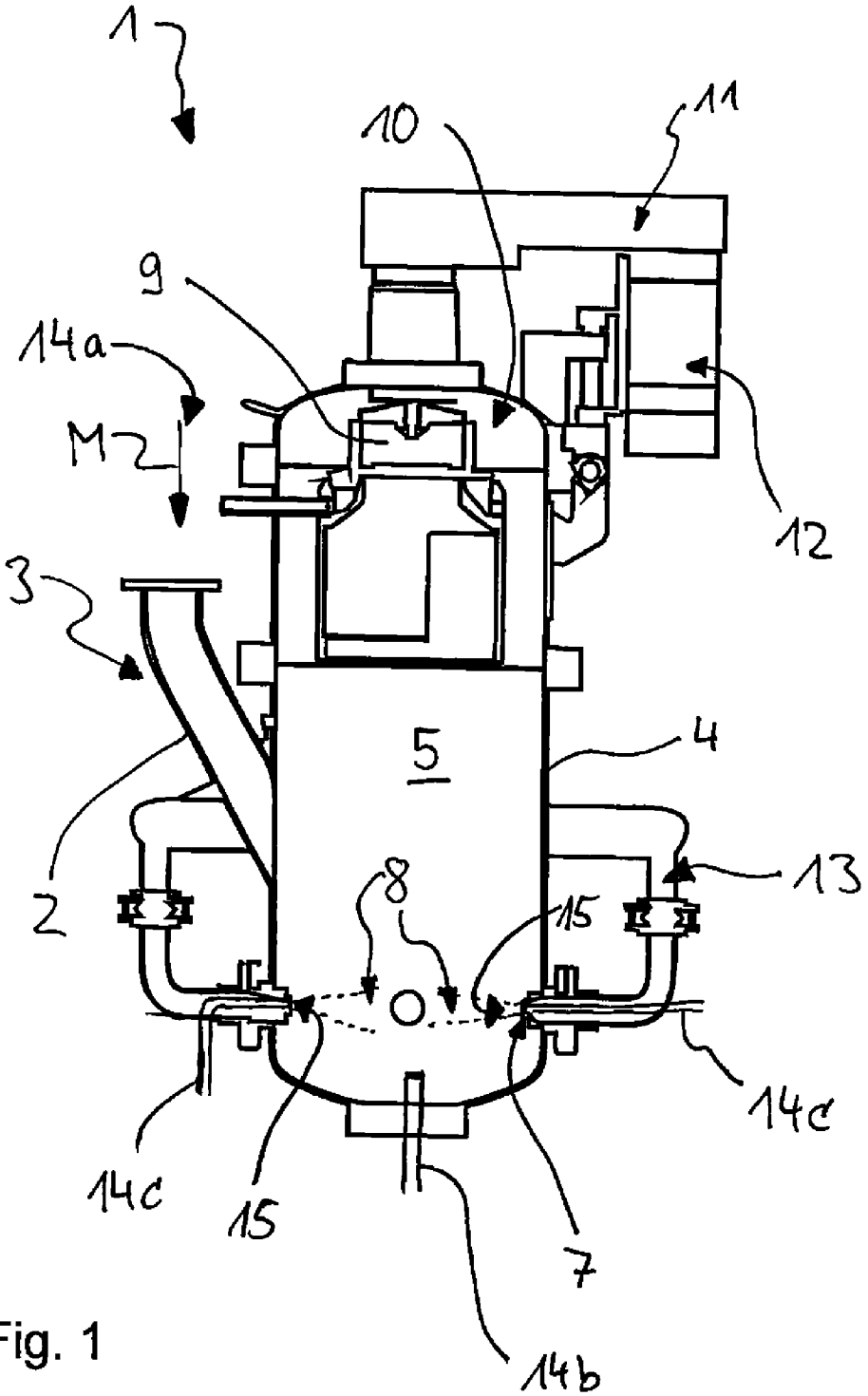
FIG. 1 shows a schematic sectional view of a fluidized bed jet mill as first exemplary embodiment.

Using the embodiments and examples of applications described in the following and illustrated in the drawings, the invention is more closely explained merely by means of examples, i.e. it is not limited to these embodiments and examples of use. Features of methods and devices respectively result analogously from descriptions of the devices and/or methods.

Individual features, which indicate and/or illustrate what in connection with an actual embodiment, are not limited to this embodiment or the combination with the other features of this embodiment, even if they are not addressed separately in the present documentation, but can be combined with any other variants within the scope of what is technically feasible.

Identical reference symbols in the individual Figures and illustrations of the drawing designate the same or similar or the same or similarly acting components. Using the illustrations in the drawing, even such features are clear that are not provided with reference symbols, regardless of the fact whether such features are described or not in the following. But on the other hand, even features that are contained in the present description but cannot be seen in the drawing or are not illustrated, can be easily understood by one skilled in the art.

In FIG. 1 is an example of a jet mill 1 as an illustration of a schematic sectional drawing of a fluidized bed jet mill. Grinding stock M is fed by means of a feeding hopper 2 of grinding stock feeding devices 3 into a mill shell 4, which surrounds a grinding space or a grinding chamber 5. In the grinding chamber 5 a product fluidized bed 6 is formed, which is fluidized by milling gas or milling steam jets 8 exiting from working stock jets 7. The process or milling gas or the process or milling steam is described as working stock.

From this product fluidized bed 6, grinding stock particles (in the following simply designated as particles) enter into the milling gas jets or milling steam jets 8, where they are accelerated to high velocities. The accelerated particles collide with each other along the milling gas jets or milling steam jets 8 as well as in the center of the grinding chamber 5 and are ground at the same time.

The unstressed working stock loaded with grinding stock particles or particles rises in the center of the jet mill 1 to a classifier wheel 9 of an integrated dynamic air classifier 10. The classifier wheel 9 is driven by means of a belt drive 11 from an adjustable-speed motor 12. Particle matter or particles which are too coarse are rejected by the classifier wheel 9 and are directly returned into the product fluidized bed 6. Fine and ultra-fine particles leave the jet mill 1 together with the working stock and are separated from the working stock in a suitable separator or dust filter.

The working stock, i.e. the process or milling gas or the process or milling steam, is routed via working stock feed devices 13 to the working stock jets 7. Superheated steam or technical gases such as He or $H_2$ are used as working stock.

To avoid the normally occurring reagglomeration, i.e. d50<2 μm, of ultra-fine particles which are produced as desired, as was discussed at the outset, further feed devices 14*a*, 14*b* and/or 14*c* are thus provided for at least one surface-active additive for the stabilization of the generated ultra-fine particles.

The feed devices 14*a*, prior to the entry of the grinding stock M into the mill shell 4 and/or the grinding chamber 5, discharge into a stock or a material stream of the grinding stock M, i.e. that the grinding stock M is already mixed anyhow with at least one surface-active additive prior to its entry into the grinding chamber 5 and therefore into the product fluidized bed 6. The mixture from grinding stock M and surface-active additive is then captured by the milling gas jets or milling steam jets 8 and treated.

The feed devices 14*b* discharge separately into the mill shell 4 and/or the grinding chamber 5, so that at least one surface-active additive can be specifically directed into the product fluidized bed 6 from grinding stock and working stock. The feed devices 14*b* must not be conducted mandatorily or only into the lower area of the milling shell 4 into the grinding chamber 5 and therefore into the product fluidized bed 6. Depending upon the circumstances of operation and the materials/substances involved, the flow into the feed devices 14*b* can alternatively or in addition also be realized above the product fluidized bed 6 up to below the classifier wheel 9.

Figure 3:
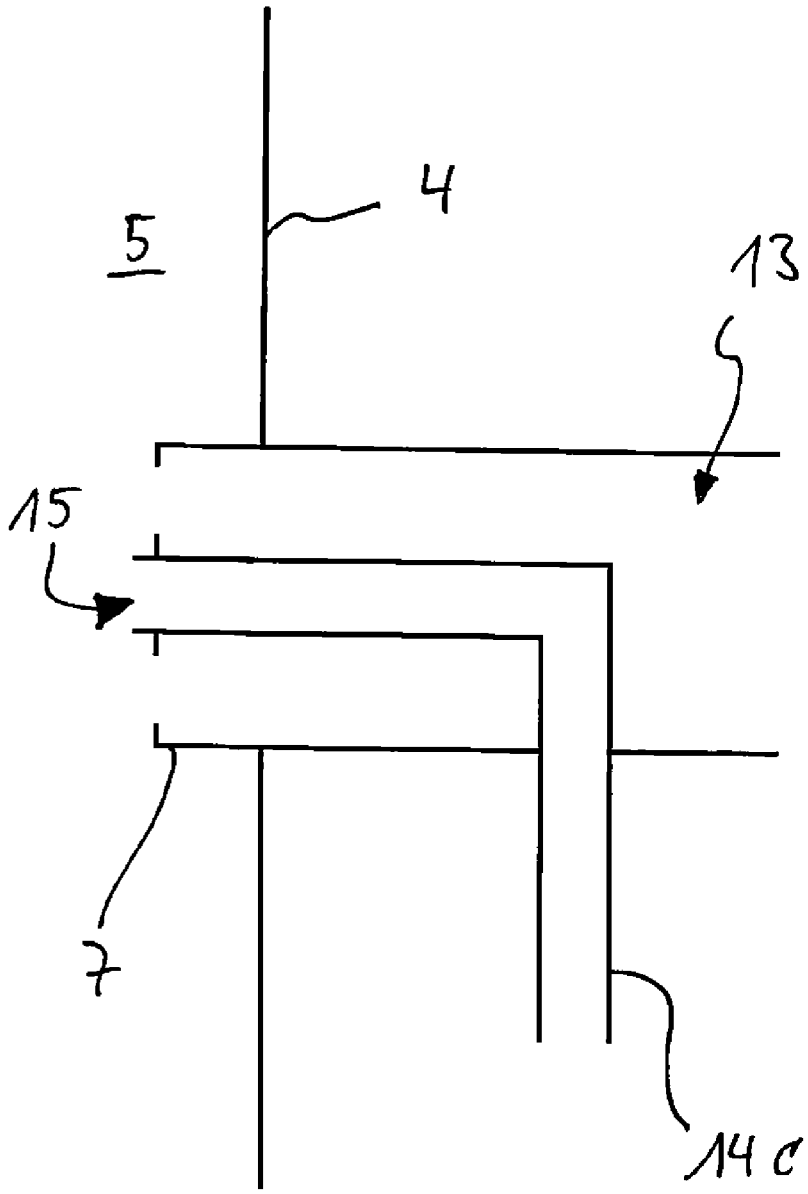
FIG. 3 shows a partial schematic sectional view of a working stock jet with a central inlet port for the at least one additive.

The feed devices 14*c* ultimately discharge into the working stock feed devices 13 or together with these into the grinding chamber 5, so that the working stock is mixed with at least one surface-active additive anyhow or transports/carries along the latter. An inlet opening 15 for the at least one additive in the mill shell 4 is arranged correspondingly for the working stock in the close vicinity of a working stock jet 7. It can be provided in particular that the working stock feed devices 13 contain at least one working stock jet 7, which surrounds a central one in the form of a ring, as the separate enlarged and partial sectional view in FIG. 3 elucidates. Especially preferred is the combination of the working stock jet 7 with the inlet port 15 for the additive as a so-called I-jet. With respect to design and functionality of I-jets, reference is made to DE 195 13 035 A1 simply for the sake of preventing repetitions, the entire content of which with respect to design and functionality of I-jets is herewith incorporated by reference in its entirety into the present documentation.

In the following, the operation of such jet mill 1 with an integrated dynamic air classifier 10 with different method variants is described.

Into the grinding chamber 5 of the jet mill 1, particles are provided as grinding stock and are ground there into ultra-fine particles by grinding. For that purpose, superheated steam or technical gases such as He or $H_2$ are used as working stock.

Furthermore, at least one surface-active additive is fed to the grinding stock for stabilization of the generated ultra-fine particles.

The grinding stock feed can be such,

- that at least one additive for stabilization of the generated ultra-fine particles is mixed with the grinding stock prior to grinding,
- so that the at least one additive for stabilization of the generated ultra-fine particles is introduced directly into the grinding chamber, and/or
- that the at least one additive for stabilization of the generated ultra-fine particles is provided to the jet mill together with the working stock.

If technical gases, such as He or $H_2$ are used as working stock, then their inlet temperature must preferably be at least 50° C.

If superheated steam is used as working stock, it is preferred if it has at least such inlet temperature so that it is in the dry form downstream of the jet mill.

Preferably, the at least one surface-active additive used for stabilization of the generated ultra-fine particles is:

- stearic acid for a hydrophobic stabilization, or
- diols, polyalcohols or other long-chain alcohols for a hydrophilic stabilization.

But for the at least one surface-active additive for stabilization of the generated ultra-fine particles, the following can also be used advantageously:

- silanes, and/or
- condensates of naphthalene sulfonic acid or phenol sulfonic acid.

Furthermore, the additive addition is preferably 0.1% to approximately 4% of the grinding stock mass flow rate of the jet mill 1.

Figure 2:
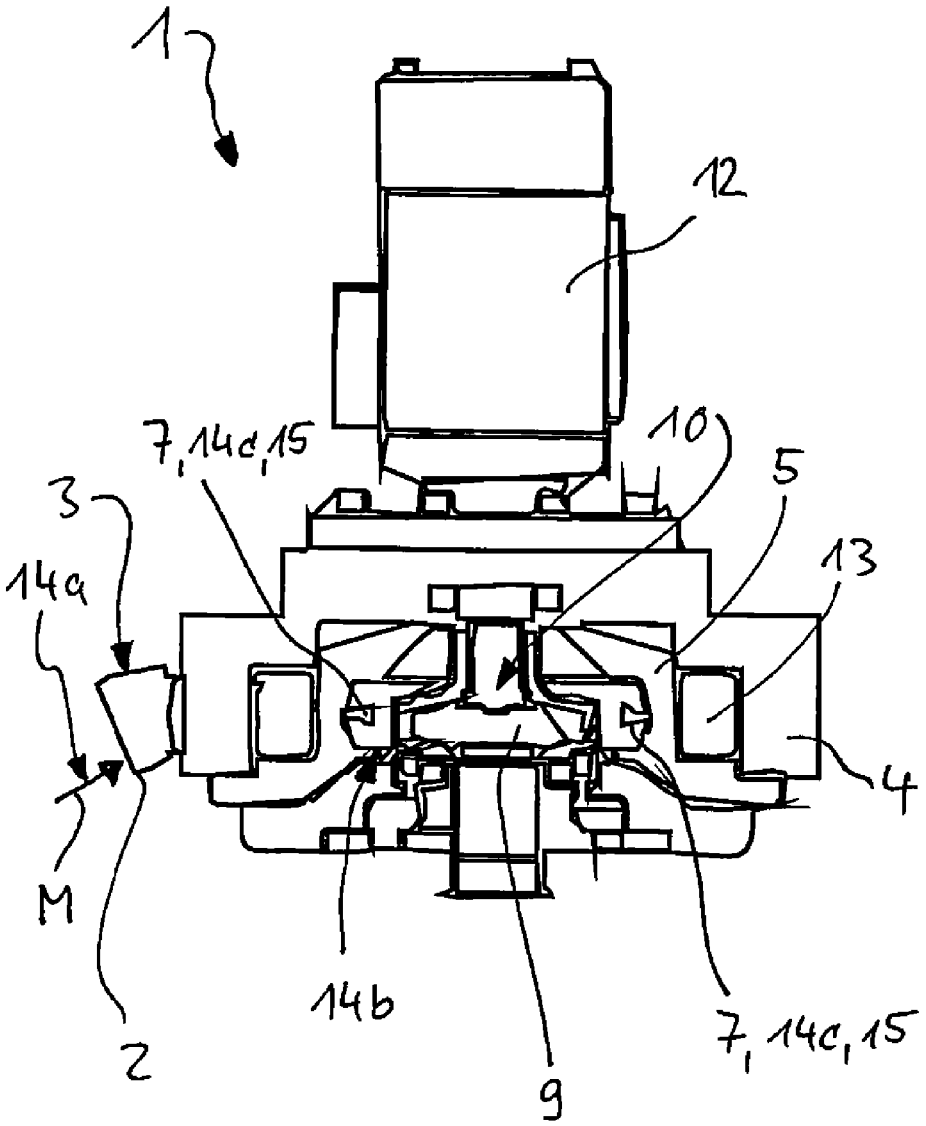
FIG. 2 shows a high-density bed jet mill as a schematic sectional view as a second exemplary embodiment.

A second embodiment of the jet mill 1 in form of a high-density bed jet mill is illustrated in a schematic sectional view in FIG. 2. Since model-specific features of the fluidized bed jet mill and the high-density bed jet mill are not important for the addition of additive, both the above data for the components of the fluidized bed jet mill as well as also the functionalities for the fluidized bed jet mill can in particular be transferred with the help of the reference symbols of the fluidized bed jet mill to the high-density bed jet mill, without requiring a repetition of the above explanations or separate facts, but obviously with the exception of the product fluidized bed 6 for the embodiment of FIG. 1. The high-density bed jet mill contains accordingly a product fluidized bed. With respect to design and functionality of high-density bed jet mills, further reference is made to DE 44 31 534 A1 simply for the sake of preventing repetitions, the entire content of which with respect to design and functionality of high-density bed jet mills is herewith incorporated by reference into the present documentation.

The effect of the use of the at least one surface-active additive is explained in detail in the following.

Surface-active additives deposit themselves during the milling as an 'ideally' monomolecular layer on the fresh fracture surfaces of sub particles and create a boundary layer on the surfaces thereof, which because of the same polarity on these surfaces effectively prevents reagglomeration. For this purpose, depending upon the further use of the ground substances, hydrophobic or hydrophilic systems can be used. The type of the "ideal" additive can also be determined depending on the grinding stock and the composition of its substances. During the various trials, when using metal oxides, carbonates, hydroxides or nitrides, long-chain alcohols have proven to be useful, for example, whereas the condensates of the naphthalenic or phenol sulfonic acid have shown better efficiency with carbon compounds.

Additives can be introduced in multifarious manners; the addition together with the grinding stock or with milling steam and/or milling gas has proven to be especially useful. When using these two types of additive addition, the distribution of the additive within the grinding stock is the most uniform.

Experimental Results:

I.

During the milling of a yellow pigment on a steam-jet mill type s-Jet 500 of the Netzsch-Condux company, for example, whilst maintaining otherwise identical parameters (steam-jet pressure, temperature, classifier speed, steam mass flow rate), a reduction of the specific energy requirement by a factor of 2.6 could be accomplished, whilst getting a more finer end product at the same time:

| | without | with additive (approx. 0.5%) |
|---|---|---|
| special adiabatic energy demand [kWh/kg] | 11.40 | 4.40 |
| $d_{99}$ [μm] | 0.36 | 0.29 |
| $d_{50}$ [μm] | 0.13 | 0.13 |

II.

When milling a blue pigment, this effect was even more prominent. Reducing the specific energy requirement achieves a factor of 3.3, with a significantly finer end product:

| | without | with additive (approx. 0.5%) |
|---|---|---|
| special adiabatic energy demand [kWh/kg] | 6.14 | 1.87 |
| $d_{99}$ [μm] | 1.10 | 0.61 |
| $d_{50}$ [μm] | 0.42 | 0.20 |

III.

Finally in the third example, a somewhat more coarser grinding of a magnesium compound is illustrated. However, there still was a reduction of the energy requirement by a factor of 1.9 while the fineness remained practically unchanged:

| | without | with additive (approx. 0.5%) |
|---|---|---|
| special adiabatic energy demand [kWh/kg] | 0.53 | 0.28 |
| $d_{99}$ [μm] | 6.70 | 6.50 |
| $d_{50}$ [μm] | 1.80 | 1.90 |

By means of the embodiments in the description and in the drawing, the invention is merely represented exemplarily and not limited thereto, but includes all variations, modifications, substitutions and combinations, which one skilled in the art can derive from the present documentation, in particular within the scope of the Claims and the general statements in the introduction of this description as well as the description of the embodiments to combine it with his expert knowledge and with the prior art. In particular, all individual features and possible embodiments of the invention can be combined.

What is claimed is:

1. A method for the operation of a jet mill having one integrated dynamic air classifier, the method comprising:

feeding particles as grinding stock into a grinding chamber of the jet mill, and grinding the particles in the grinding chamber into ultra-fine particles, in that superheated steam or technical gases is/are used as working stock, wherein at least one surface-active additive is fed into the grinding stock for stabilization of the generated ultra-fine particles.

2. The method of claim 1, wherein the at least one surface-active additive for stabilization of the generated ultra-fine particles is mixed with the grinding stock prior to the step of grinding.

3. The method of claim 1, wherein the at least one additive for stabilization of the generated ultra-fine particles is introduced directly into the grinding chamber.

4. The method of claim 1, wherein the at least one additive for stabilization of the generated ultra-fine particles of the jet mill is fed together with the working stock.

5. The method of claim 1, wherein the working stock contains technical gases and has an inlet temperature of at least 50° C.

6. The method of claim 1, wherein the working stock is superheated steam, which has at least such inlet temperature, so that it is dry downstream of the jet mill.

7. The method of claim 1, wherein the at least one surface-active additive for stabilization of the generated ultra-fine particles contains:

stearic acid for a hydrophobic stabilization, or diols, polyalcohols or other long-chain alcohols for a hydrophilic stabilization.

8. The method of claim 1, wherein the at least one surface-active additive for stabilization of the generated ultra-fine particles contains:

silanes, and/or condensates of naphthalene sulfonic acid or of phenol sulfonic acid.

9. The method of claim 1, wherein the addition of additive is approximately 0.1% to approximately 4% of the grinding stock mass flow rate of the jet mill.

10. The method of claim 1, wherein the technical gases comprise He or $H_2$.

* * * * *